US010990053B2

(12) United States Patent
Araki et al.

(10) Patent No.: US 10,990,053 B2
(45) Date of Patent: Apr. 27, 2021

(54) IMAGE FORMING APPARATUS, CARTRIDGE, IMAGE FORMING SYSTEM, AND STORAGE MEDIUM FOR CORRECTING EXPOSURE AMOUNTS

(71) Applicant: CANON KABUSHIKI KAISHA, Tokyo (JP)

(72) Inventors: Go Araki, Suntou-gun (JP); Yoshihiro Mitsui, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/884,165

(22) Filed: May 27, 2020

(65) Prior Publication Data

US 2020/0379392 A1 Dec. 3, 2020

(30) Foreign Application Priority Data

May 29, 2019 (JP) ..... JP2019-100727

(51) Int. Cl.
*G03G 15/00* (2006.01)
*G03G 15/043* (2006.01)
*G03G 21/18* (2006.01)

(52) U.S. Cl.
CPC ..... *G03G 15/5066* (2013.01); *G03G 15/043* (2013.01); *G03G 21/18* (2013.01); *G03G 2215/047* (2013.01)

(58) Field of Classification Search
CPC .. G03G 15/5066; G03G 21/18; G03G 15/043; G03G 2215/047
See application file for complete search history.

(56) References Cited

U.S. PATENT DOCUMENTS

| | | | | |
|---|---|---|---|---|
| 9,298,124 | B2 | 3/2016 | Araki et al. | |
| 10,514,627 | B2 * | 12/2019 | Suzuki | H04N 1/506 |
| 2017/0131655 | A1 * | 5/2017 | Araki | H04N 1/00 |
| 2019/0064694 | A1 * | 2/2019 | Nagai | G03G 15/0409 |

FOREIGN PATENT DOCUMENTS

| | | | |
|---|---|---|---|
| JP | 2004-299239 | A | 10/2004 |
| JP | 2006-173744 | A | 6/2006 |
| JP | 2011-158761 | A | 8/2011 |
| JP | 2015-138101 | A | 7/2015 |

* cited by examiner

*Primary Examiner* — Susan S Lee
(74) *Attorney, Agent, or Firm* — Venable LLP

(57) ABSTRACT

An image forming apparatus includes a storage unit configured to store correction data; an identifying unit configured to identify a correction amount for a correction target pixel based on the correction data stored in the storage unit; a correction unit configured to correct an exposure amount of the correction target pixel among a plurality of pixels indicated by image data, from an exposure amount indicated by the image data, based on the correction amount for the correction target pixel; and an image forming unit configured to form an image based on an exposure amount after correction by the correction unit. The correction data includes only a correction amount corresponding to each of representative parameter values of a plurality of parameter values of a parameter for varying the correction amount.

28 Claims, 10 Drawing Sheets

FIG. 2

| SPEED MODE | SPEED | TARGET | OCCURRENCE WIDTHS |
|---|---|---|---|
| FIRST | Sr | NORMAL PAPER | 5 |
| SECOND | Sr/2 | THICK PAPER | 5 |
| THIRD | Sr/3 | GLOSS PAPER | 7 |

FIG. 8

| SPEED MODE | DISTANCE FROM EDGE | CORRECTION AMOUNT |
|---|---|---|
| FIRST | 1 | 30% |
| | 2 | 40% |
| | 3 | 50% |
| | 4 | 40% |
| | 5 | 30% |
| SECOND | 1 | 24% |
| | 2 | 36% |
| | 3 | 45% |
| | 4 | 36% |
| | 5 | 24% |
| THIRD | 1 | 30% |
| | 2 | 47% |
| | 3 | 56% |
| | 4 | 60% |
| | 5 | 56% |
| | 6 | 46% |
| | 7 | 30% |

| SPEED MODE | DISTANCE FROM EDGE | CORRECTION AMOUNT |
|---|---|---|
| FIRST | 5 | 30% |
| | 3 | 50% |
| | 1 | 30% |
| SECOND | 5 | 24% |
| | 3 | 45% |
| | 1 | 24% |
| THIRD | 7 | 30% |
| | 4 | 60% |
| | 1 | 30% |

IMAGE FORMING APPARATUS, CARTRIDGE, IMAGE FORMING SYSTEM, AND STORAGE MEDIUM FOR CORRECTING EXPOSURE AMOUNTS

BACKGROUND OF THE INVENTION

Field of the Invention

The present invention relates to a technique for suppressing the phenomenon of excessive toner adhesion in an image forming apparatus.

Description of the Related Art

In an image forming apparatus, a phenomenon called "edge effect" in which toner (developer) excessively adheres to an edge of an image being formed, or a phenomenon called "sweeping" in which toner excessively adheres to the rear end of the image to be formed in the sub-scanning direction may occur. Japanese Patent Laid-Open No. 2004-299239 discloses a configuration for suppressing the phenomenon of excessive toner adhesion. According to Japanese Patent Laid-Open No. 2004-299239, excessive toner adhesion is suppressed by reducing exposure intensity of an image region of a certain area.

The degree of the edge effect and sweeping may vary depending on various parameters such as the distance from an edge of an image, aging of image forming apparatus, change of environmental conditions, or the like. However, in any situation, suppressing the edge effect and sweeping is desirable.

SUMMARY OF THE INVENTION

According to an aspect of the present invention, an image forming apparatus includes: a storage unit configured to store correction data; an identifying unit configured to identify a correction amount for a correction target pixel, based on the correction data stored in the storage unit; a correction unit configured to correct an exposure amount of the correction target pixel among a plurality of pixels indicated by image data, from an exposure amount indicated by the image data, based on the correction amount for the correction target pixel; and an image forming unit configured to form an image based on an exposure amount after correction by the correction unit, wherein the correction data includes only a correction amount corresponding to each of representative parameter values of a plurality of parameter values of a first parameter for varying the correction amount.

Further features of the present invention will become apparent from the following description of exemplary embodiments with reference to the attached drawings.

BRIEF DESCRIPTION OF THE DRAWINGS

FIG. 2 illustrates a relation between speed mode and occurrence width according to one embodiment;

FIG. 8 illustrates correction amount data according to one embodiment;

DESCRIPTION OF THE EMBODIMENTS

Figure 1:
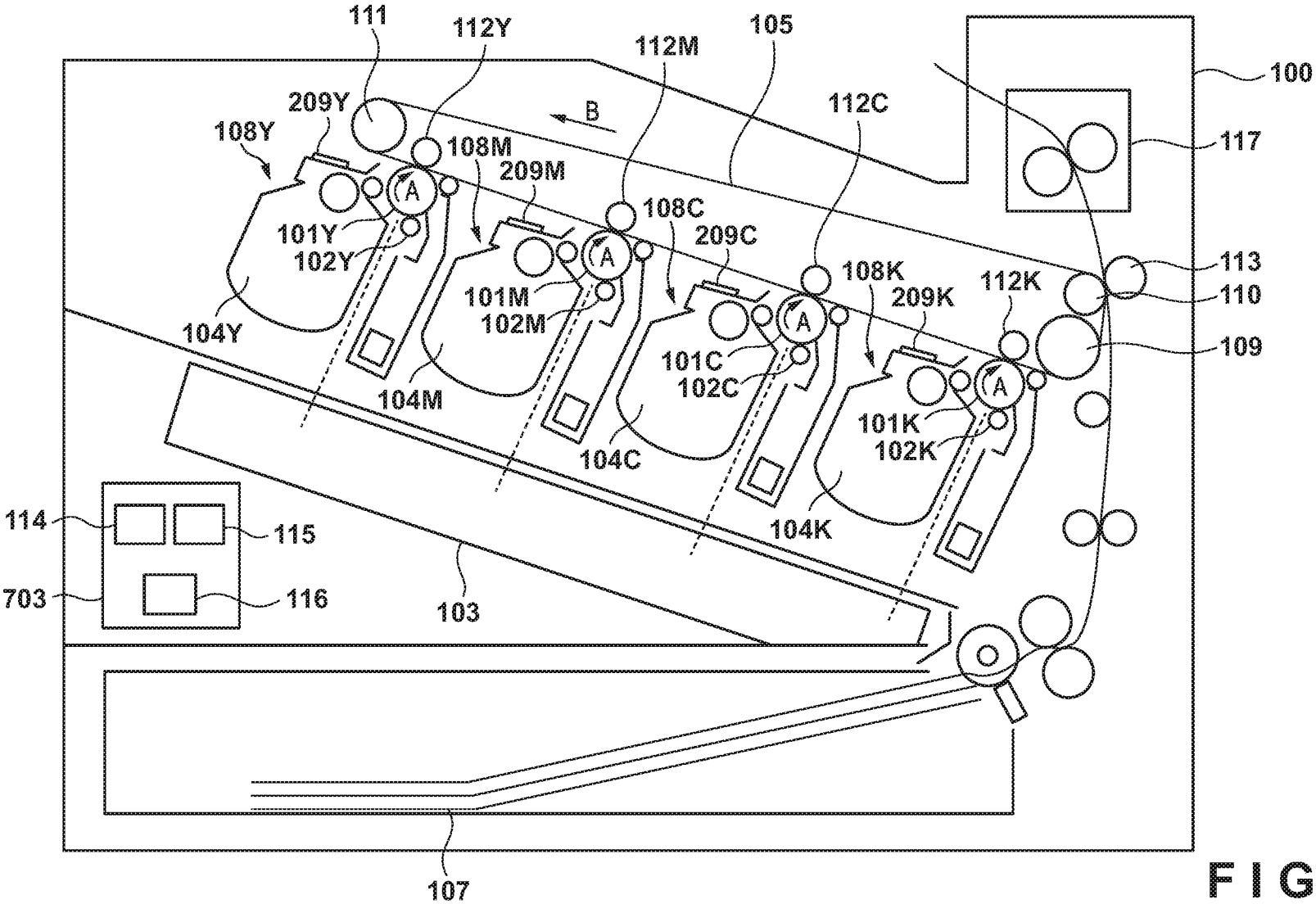
FIG. 1 is a configuration diagram of an image forming apparatus according to one embodiment.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate.

Furthermore, in the attached drawings, the same reference numerals are given to the same or similar configurations, and redundant description thereof is omitted.

First Embodiment

FIG. 1 is a configuration diagram of an image forming apparatus 10 according to the present embodiment. In the diagrams described below, Y, M, C, and K at the end of reference numerals indicate that toner colors are yellow, magenta, cyan, and black, respectively, for members indicated by the reference numerals, which are involved in image formation. When it is not necessary to distinguish the colors from each other in the following description, reference numerals without characters at their end are used. A photoconductor 101 is rotationally driven in the direction A in FIG. 1 when forming an image. A charge roller 102 charges the surface of the corresponding photoconductor 101 to a uniform electric potential. An exposing device 103 exposes the surface of each photoconductor 101 to light to form an electrostatic latent image on each photoconductor 101. A developing unit 104, including a developing roller 202 (FIG. 3), applies a developing bias voltage to develop an electrostatic latent image of the photoconductor 101 with toner (developer) and form a toner image on the photoconductor 101. A primary transfer roller 112 transfers the toner image of the corresponding photoconductor 101 to an intermediate transfer belt 105 by outputting a primary transfer bias voltage. Here, it is possible to form a full-color toner image on the intermediate transfer belt 105 by transferring the toner image formed on each photoconductor 101 to the intermediate transfer belt 105 in an overlapping manner.

The intermediate transfer belt 105, being stretched by a drive roller 109, a secondary transfer counter roller 110, and a follower roller 111, is rotationally driven in the direction B of FIG. 1 when forming an image. Therefore, the toner image transferred to the intermediate transfer belt 105 is conveyed to an opposing position of a secondary transfer roller 113. On the other hand, the recording material (sheet) 107 in the cassette is conveyed by each roller along the conveyance path to the opposing position of the secondary transfer roller 113. The secondary transfer roller 113 transfers the toner image of the intermediate transfer belt 105 to the recording material 107 by outputting a secondary transfer bias voltage. The recording material 107 to which the toner image has been transferred is conveyed to a fixing unit 117. The fixing unit 117 pressurizes and heats the recording material 107 to fix the toner image on the recording material 107. The recording material 107 on which the toner image has been fixed is discharged to the outside of the image forming apparatus 100.

A controller 703, which functions as a control unit, includes a CPU 114, an application specific integrated circuit (ASIC) 115, a memory 116, or the like. Each operation including the image forming operation in the image forming apparatus 100 is controlled by the controller 703. A cartridge 108 including the photoconductor 101, the charging roller 102, the developing unit 104, and a storage medium 209 is configured to be attachable to and detachable from the main body of the image forming apparatus 100. In other words, the cartridge 108 is a replaceable unit of the image forming apparatus 100, and is used after being attached to the image forming apparatus 100. The storage medium 209 provided on the cartridge 108 is a non-volatile memory, for example, having stored therein correction data indicating correction parameters described below.

The image forming apparatus 100 of the present embodiment has three speed modes as illustrated in FIG. 2. A speed mode, indicating a process speed such as the rotation speed of the photoconductor or the conveyance speed of sheets, is selected in the present example according to the type of the recording material 107 on which an image is to be formed. According to FIG. 2, a first mode, a second mode, and a third mode are selected, respectively, for normal paper, thick paper, and gloss paper. Here, the second mode exhibits a speed half that of the first mode, and the third mode exhibits a speed one-third that of the first mode. Note that the speed mode illustrated in FIG. 2 is exemplary, and the number of speed modes, and the relation between speed modes and types of the recording material 107 are not limited to those illustrated in FIG. 2.

Figure 3A:
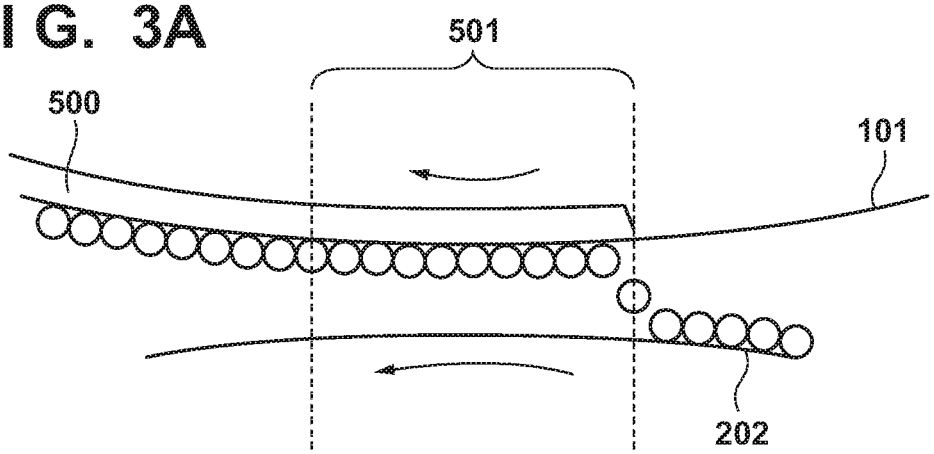
FIGS. 3A to 3C are explanatory diagrams of causes of sweeping.
Figure 3B:
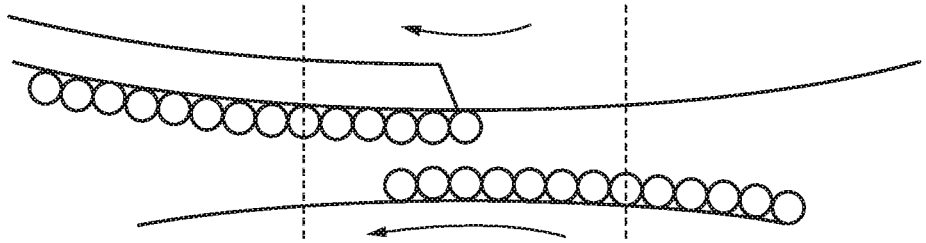
Figure 3C:
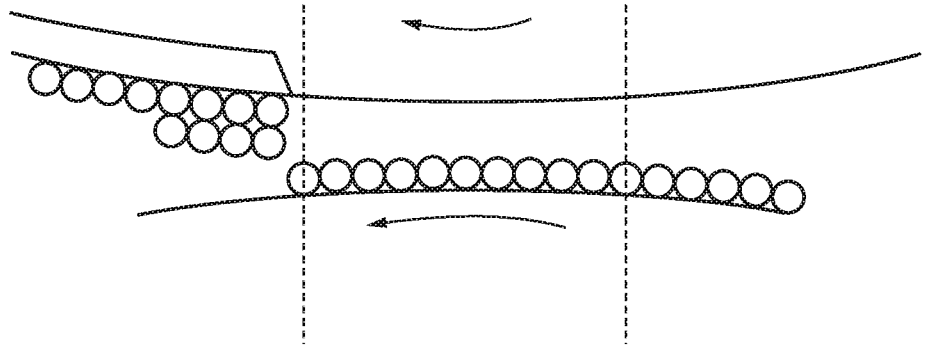

Subsequently, sweeping and the edge effect will be described. Sweeping is a phenomenon in which toner accumulates at the rear end of a toner image in the rotation direction of the photoconductor 101. FIGS. 3A to 3C are explanatory diagrams of causes of sweeping. Here, in FIGS. 3A to 3C, toner is indicated by a circle. The circumferential speed of the developing roller 202 is controlled to be faster than the circumferential speed of the photoconductor 101, in order to set the thickness of the toner on the photoconductor 101 to a predetermined value. As illustrated in FIG. 3A, the toner on the developing roller 202 is located rearward of the starting position of the developing region 501 in the rotational direction at the time when the rear end of an electrostatic latent image 500 enters a developing region 501. However, the circumferential speed of the developing roller 202 is higher than the circumferential speed of the photoconductor 101, and therefore the toner on the developing roller 202 overtakes the rear end of the electrostatic latent image 500 by the time the rear side of the electrostatic latent image 500 exits the developing region 501, as illustrated in FIG. 3B. Accordingly, as illustrated in FIG. 3C, a larger amount of the toner on the developing roller 202 is supplied to the rear end of the electrostatic latent image 500, whereby the amount of toner adhering to the rear end of the electrostatic latent image increases. This is the mechanism by which sweeping occurs.

Figure 4A:
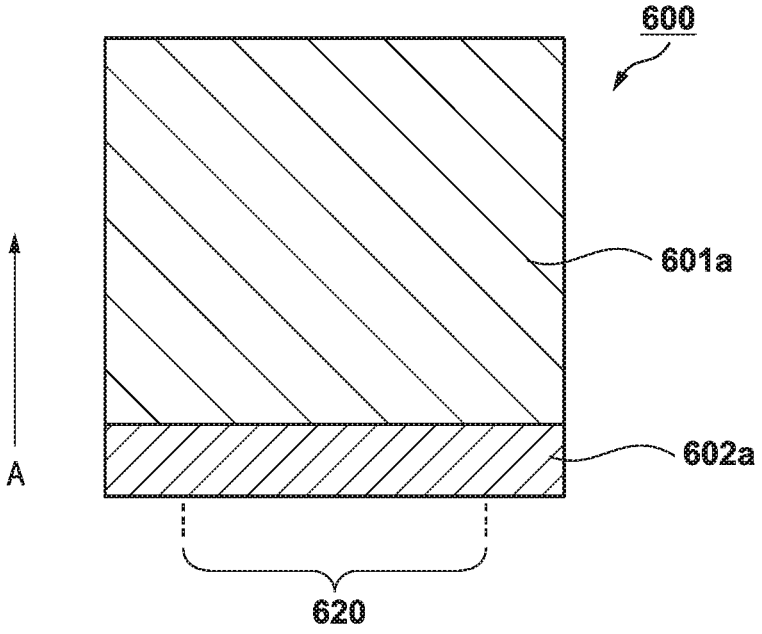
FIG. 4A illustrates an image on which sweeping has occurred.

FIG. 4A illustrates a toner image 600 on which sweeping has occurred. The arrow A in FIG. 4A indicates the conveyance direction of the toner image, i.e., the rotation direction of the photoconductor 101. Here, the underlying image data of the toner image 600 has a same value for all of the pixels, in other words, the toner image 600 is an image of uniform density. In the event of occurrence of sweeping, toner accumulatively adheres to the rear end region 602*a* of the toner image 600. As a result, the density in the rear end region 602*a* becomes higher than the density in a region 601*a* other than the rear end region 602*a*.

Figure 5:
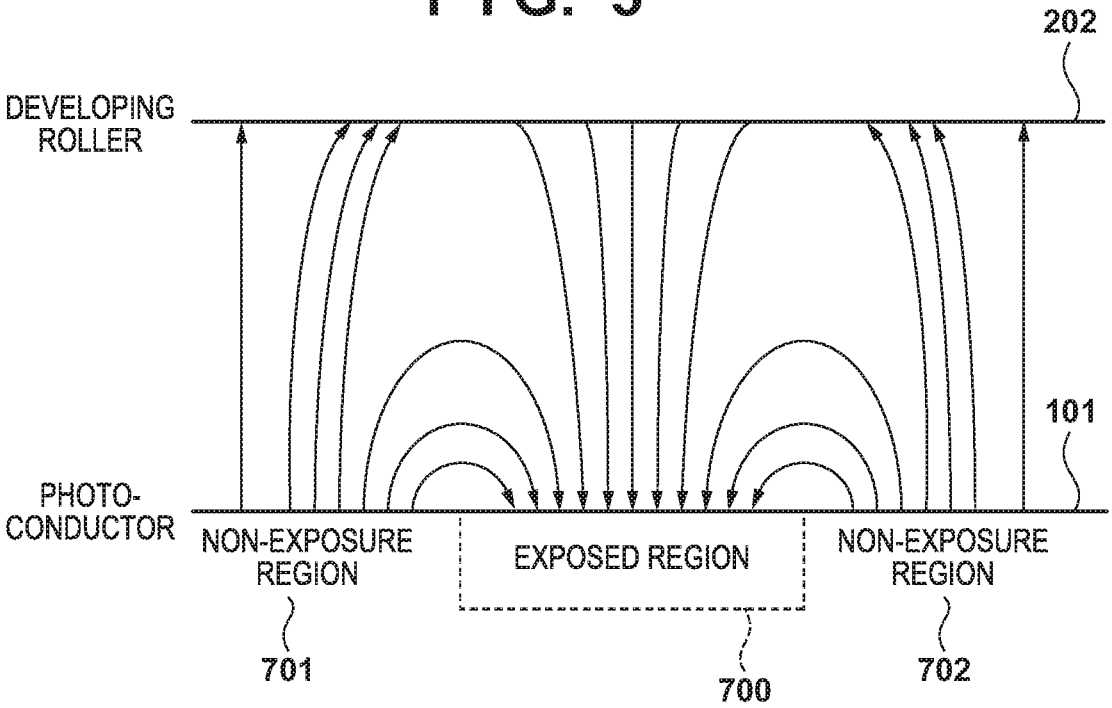
FIG. 5 is an explanatory diagram of a cause of an edge effect.

On the other hand, edge effect is a phenomenon of excessive toner adhesion to each edge of an electrostatic latent image formed on the photoconductor 101. FIG. 5 is an explanatory diagram of the reason why edge effect occurs. As illustrated in FIG. 5, electric flux lines from non-exposure regions 701 and 702 surrounding an exposed region 700 of the photoconductor 101 extend around toward an edge of the exposed region 700, whereby the electric field intensity at the edge becomes stronger than other regions of the exposed region 700. Therefore, toner excessively adheres to the edge of the exposed region 700, resulting in a higher density than other regions. This is the mechanism by which the edge effect occurs.

Figure 4B:
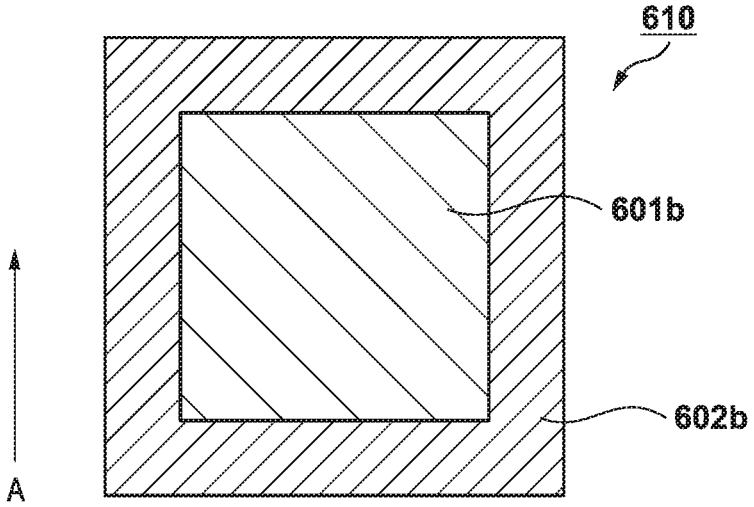
FIG. 4B illustrates an image on which an edge effect has occurred.

FIG. 4B illustrates a toner image 610 on which an edge effect has occurred. An arrow A in FIG. 4B indicates the conveyance direction of the toner image, i.e., the rotation direction of the photoconductor 101. Here, the underlying image data of the toner image 610 has a same value for all of the pixels, in other words, the toner image 610 is an image of uniform density. In the event of occurrence of the edge effect, toner accumulatively adheres to an edge region 602*b* around the toner image 610. As a result, the density in the edge region 602*b* becomes higher than the density in a non-edge region 601*b*.

Here, the degree of sweeping and the edge effect, i.e., the range of pixels on which toner excessively adheres, and the amount of excessively adhering toner may vary depending on the speed mode and the distance from the edge of pixels. FIG. 2 also illustrates an example of occurrence widths of sweeping and the edge effect for respective speed modes. Note that the occurrence widths are expressed by the numbers of pixels from the edge. In the first mode, the density becomes high over five pixels from the edge due to sweeping or edge effect. Also in the second mode, the density becomes high over five pixels from the edge due to sweeping or edge effect. On the other hand, the density becomes high over seven pixels from the edge in the third mode, due to sweeping or edge effect. Here, although not illustrated in FIG. 2, the amount of toner increased due to sweeping or edge effect may also depend on the distance from the edge and the speed mode. In other words, in the first mode, the increased amount of toner on a pixel at a distance of "1" from the edge may differ from the increased amount of toner on a pixel at a distance of "2" from the edge. In addition, the increased amount of toner on a pixel at a distance of "1" from the edge may be different for the first mode and the second mode.

Figure 6:
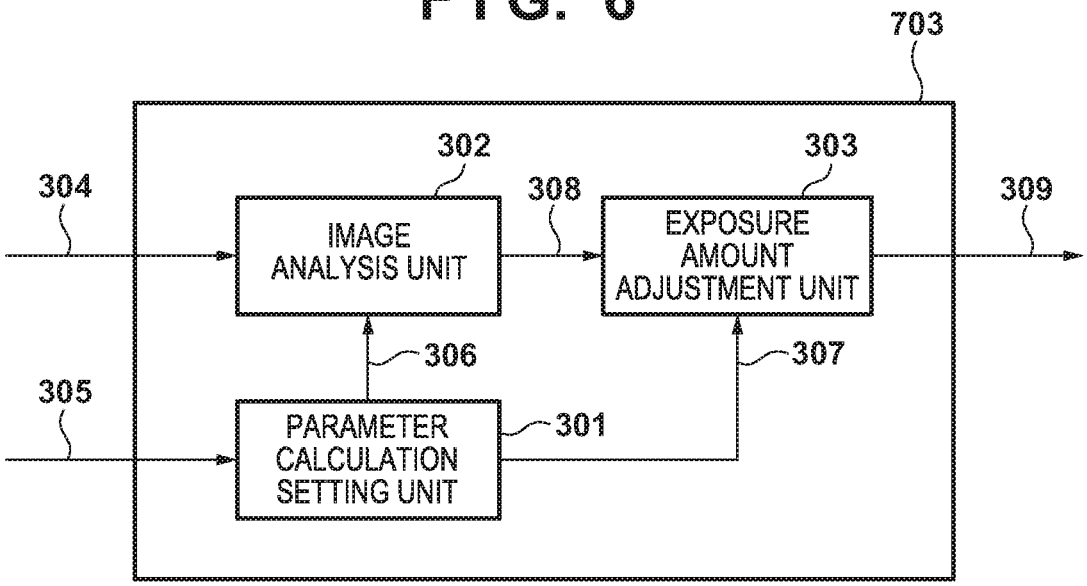
FIG. 6 is a configuration diagram of a controller according to one embodiment.

FIG. 6 is a configuration diagram of the controller 703. The parameter calculation setting unit 301 reads correction data (correction information) 305 from the storage medium 209 of the cartridge 108, and calculates range data 306 and correction amount data 307. The range data 306 is information for identifying a correction target pixel whose toner amount increases due to sweeping or edge effect. In addition, the correction amount data 307 is information for identifying an amount for correcting the exposure amount for the correction target pixel. The parameter calculation setting unit 301 notifies an image analysis unit 302 of the range data 306, and notifies an exposure amount adjustment unit 303 of the correction amount data 307. The image analysis unit 302 determines a correction target pixel from respective pixels of an image indicated by the image data 304 based on the range data 306, and outputs analyzed image data 308. The analyzed image data 308 includes the image data 304 and information indicating the correction target pixel. The exposure amount adjustment unit 303 performs a correction process on the analyzed image data 308 based on the correction amount data 307. More specifically, the exposure amount adjustment unit 303 corrects the exposure amount of the correction target pixel based on the analyzed image data 308, and based on the correction amount data 307 from the exposure amount indicated by the image data 304. Subsequently, the exposure amount adjustment unit 303 generates a drive signal 309 based on the corrected exposure amount and outputs the drive signal 309 to the exposing device 103. The exposing device 103 exposes each photoconductor 101 to light based on the drive signal 309.

Figure 7A:
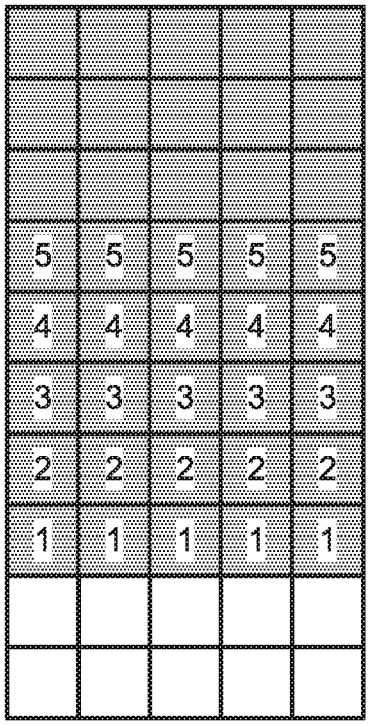
FIGS. 7A and 7B illustrate correction target pixels according to one embodiment.
Figure 7B:
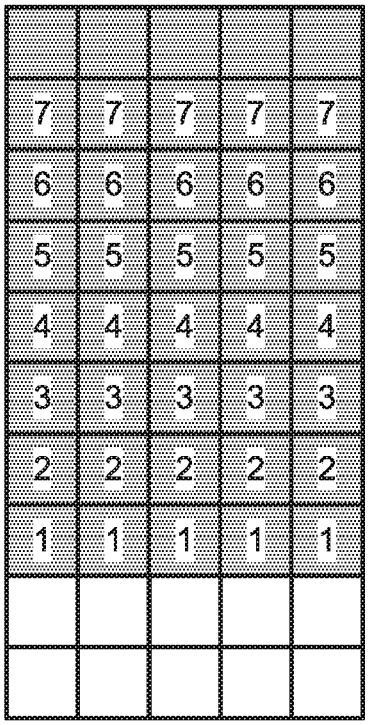

Subsequently, an analysis process in the image analysis unit 302 will be described. FIGS. 7A and 7B are enlarged views of a region 620 of the toner image 600 illustrated in FIG. 4A. In FIGS. 7A and 7B, shaded squares represent pixels with toner adhering thereto, and white squares represent pixels without toner adhering thereto. Therefore, a boundary between a white square and a shaded square defines an edge of the image. Here, occurrence widths of sweeping or edge effect are identical to those illustrated in FIG. 2. In this case, the range data 306 is information indicating the occurrence widths illustrated in FIG. 2. In other words, the range data 306 is information indicating "5" for the first mode and the second mode, and "7" for the third mode. Accordingly, the image analysis unit 302 determines the five pixels from the edge to be correction target pixels in the case of the first mode or the second mode, and determines the seven pixels from the edge to be correction target pixels in the case of the third mode. The numbered pixels in FIG. 7A indicate the pixels determined to be correction target pixels by the image analysis unit 302 when the speed mode is the first mode or the second mode. The numbered pixels in FIG. 7B indicate the pixels determined to be correction target pixels by the image analysis unit 302 when the speed mode is the third mode. Here, the numbers in FIGS. 7A and 7B indicate the distance from the edge as the number of pixels.

FIG. 8 illustrates the correction amount data 307. The correction amount data 307 indicates the correction amount (exposure correction amount) of the exposure amount of the correction target pixel for the first to the third modes, respectively. For example, in the case of the first mode, the exposure correction amount at a distance of 1, 2, 3, 4 or 5 pixels from the edge is indicated to be 30%, 40%, 50%, 40% or 30%, respectively. Here, the correction amount being X % in the present example means that the corrected exposure amount turns out to be Y×X/100, where Y is the exposure amount before correction indicated by the image data 304. Here, the correction amount is not limited to being indicated by the ratio of the corrected exposure amount relative to the exposure amount before correction, and any numerical value or formula that can determine the corrected exposure amount from the exposure amount before correction may be used as the correction amount.

Figure 9A:
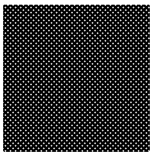
FIGS. 9A to 9F are explanatory diagrams of a correction method of exposure amount according to one embodiment.
Figure 9B:
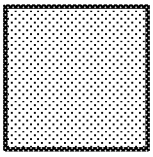
Figure 9C:
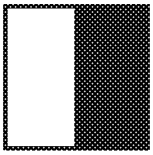
Figure 9D:
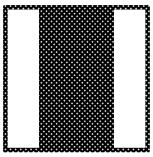
Figure 9E:
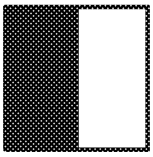
Figure 9F:
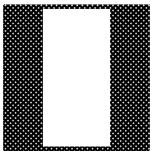

FIGS. 9A to 9F are explanatory diagrams of a correction method of the exposure amount of a correction target pixel to be performed by the exposure amount adjustment unit 303. FIGS. 9A to 9F illustrate one pixel, respectively. FIG. 9A illustrates a state in which the entire region of one pixel is exposed with a predetermined exposure intensity, which is defined as the exposure amount before correction. In a case where FIG. 9A illustrates a correction target pixel whose correction amount is 50%, FIGS. 9B to 9F illustrate, respectively, a method for exposing the corrected pixel. FIG. 9B illustrates a state in which the entire region of one pixel is exposed with an exposure intensity equivalent to 50% of the exposure intensity of FIG. 9A. FIGS. 9C to 9F all illustrate a state in which one pixel is divided into four subpixels, only two of which are exposed, with the exposure intensity being the same as that of FIG. 9A. The exposure amount adjustment unit 303 corrects, as described above, the exposure amount by controlling the exposure intensity or the number of exposure regions within one pixel.

Figures 10, 11:
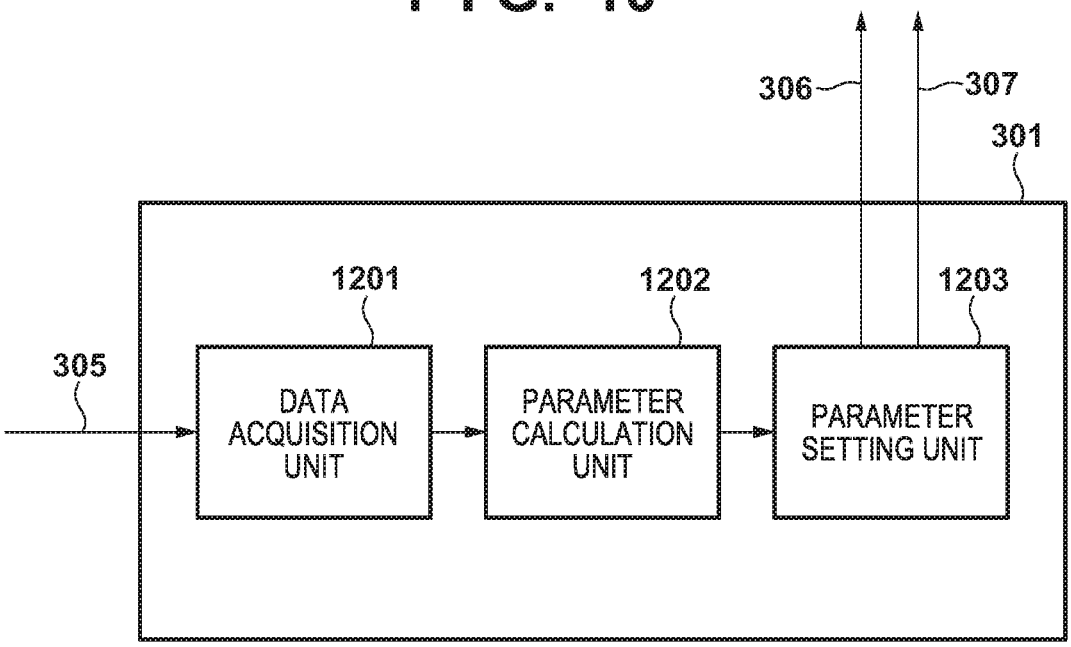
FIG. 10 is a configuration diagram of a parameter calculation setting unit according to one embodiment.
FIG. 11 illustrates correction data according to one embodiment.

FIG. 10 is a configuration diagram of the parameter calculation setting unit 301. A data acquisition unit 1201 acquires correction data 305 stored in the storage medium 209 of the cartridge 108, and outputs the correction data 305 to a parameter calculation unit 1202. The parameter calculation unit 1202 calculates the range data 306 and the correction amount data 307 based on the correction data 305. A parameter setting unit 1203 outputs the range data 306 calculated by the parameter calculation unit 1202 to the image analysis unit 302, and outputs the correction amount data 307 to the exposure amount adjustment unit 303.

FIG. 11 illustrates the correction data 305 to be stored in the storage medium 209. In the present embodiment, as illustrated in FIG. 11, the correction data 305 is not information indicating the correction amount for all the correction target pixels. In the present embodiment, the correction data 305 includes at least the correction value for the minimum value (distance of "1") and the maximum value (distance of "5" or "7") of the range of the distance from the edge of the correction target pixel (hereinafter, simply referred to as distance). Furthermore, assuming that the correction amount is a function of the distance from the edge, the correction data 305 includes the distance at which the function is to be modified, and the correction amount at that time. Specifically, in FIG. 11, distances of boundaries exhibiting reversal of increase and decrease of the correction amount with respect to variation of distance, and the correction amount at that time are included. For example, in the first mode and the second mode, the correction amount reverses from increase to decrease at a distance of "3" as illustrated in FIG. 8, and therefore the distance of "3" and the correction amount at the distance of "3" are included in the correction data 305. Additionally, in the third mode, the correction amount reverses from increase to decrease at a distance of "4", and therefore the distance of "4" and the correction amount at the distance of "4" are included in the correction data 305.

Note that there may also be a configuration including the distance of the boundary at which the variation amount of the correction amount with respect to the variation of distance is larger than a predetermined value, and the correction amount at that time. For example, it is assumed that the correction target pixels are 10 pixels from the edge, and the increased amount of the correction amount is 4% when the distance increases by "1" within the distances of "1" to "3", whereas the increased amount of the correction amount is 10% when the distance increases by "1" within the distances of "3" to "6". Furthermore, it is assumed that the increased amount of the correction amount is −10% when the distance increases by "1" within the distances of "6" to "10". The predetermined value is then assumed to be 4%. In this case, at the distance of "3", the increased amount varies from 4% to 10% by 6%, which is a larger increment than the predetermined value of 4%, and therefore the correction amount reverses from increase to decrease at the distance of "6". In this case, therefore, the correction data 305 turns out to be information indicating the distances of "1", "3", "6" and "10", and the correction amount at respective distances.

The parameter calculation unit 1202 calculates the range data 306 based on the minimum value and the maximum value of the distance of the correction data 305 illustrated in FIG. 11. Furthermore, the parameter calculation unit 1202 calculates the correction amount for the distance of "2" by linear interpolation of the correction amounts for the distance of "1" and the distance of "3", and calculates the correction amount for the distance of "4" by linear interpolation of the correction amounts for the distance of "3" and the distance of "5". Here, in the case of the second mode, the correction amounts for the distance of "2" and the distance of "4" turn out to be 35%, respectively, and although an error may occur thereby, it is possible to reduce the amount of data to be preliminarily stored in the storage medium 209 by storing the correction data 305 as described in the present embodiment, provided that the effect due to the error is small. In addition, for the third mode, the parameter calculation unit 1202 obtains a quadratic function indicating the relation between distance and correction amount, based on the correction amounts for the distances of "1", "4" and "7". For example, in the present example, letting Y be the correction amount and X be the distance, the following quadratic function is obtained.

$$3Y=-10X^2+80X+20$$

Note that it is also intended to include, in the correction data 305, calculation method information about whether to perform linear interpolation or to determine the function, when there coexist, as in the present example, a case of using a simple linear interpolation according to the speed mode and a case of determining the function based on the distance and the correction amount indicated by the correction data. Here, when using only linear interpolation or only performing determination of the function, regardless of the speed mode, it is not necessary to include the calculation method information in the correction data 305.

Additionally, in FIG. 11, the correction amount in the second mode is a value approximately 0.8 times the correction amount in the first mode, and therefore there may also be a configuration having preliminarily stored in the storage medium 209 the multiplying coefficient of "0.8" for the second mode relative to the first mode. In this case, the parameter calculation unit 1202 calculates the correction amount for each distance in the second mode by multiplying the correction amount for each distance in the first mode by 0.8. Furthermore, in the present embodiment, it is assumed that the correction data 305 includes information indicating the correction amount for the minimum value and the maximum value of the distance, from which the range data 306 is calculated. However, it is also conceivable to include the range of correction target pixels in the correction data 305 as range information, separately from the correction amount. For example, in a case of determining a function indicating the relation between the distance and the correction amount as in the third mode, there may be a configuration that includes only the distance and the correction amount required for determination of the function, and determines correction target pixels based on the range information in the correction data 305.

As has been described above, only correction amounts for some of the distances are preliminarily stored, instead of storing correction amounts for all the distances in the storage medium 209 as the correction data 305. The parameter calculation unit 1202 then calculates the range data 306 and the correction amount data 307 based on the correction data 305. The aforementioned configuration allows for reducing the amount of the correction data 305 and suppressing the phenomenon of excessive toner adhesion in each speed mode.

Note that, although the speed mode is assumed to be selected based on the type of sheet in the present embodiment, selection of the speed mode may be performed according to any criteria. Here, the degree of occurrence of sweeping and the edge effect may also vary depending on the ratio or difference between the circumferential speeds of the photoconductor 101 and the developing roller 202. In other words, more generally, the degree of occurrence of sweeping and the edge effect may vary depending on the operation mode with respect to the speed of the image forming apparatus and the distance from an edge of a pixel. Here, the operation mode with respect to the speed of the image forming apparatus may be a mode with respect to, for example, processing speed, sheet conveyance speed, ratio or difference between the circumferential speeds of the photoconductor 101 and the developing roller 202, or the like.

Second Embodiment

Figure 12A:
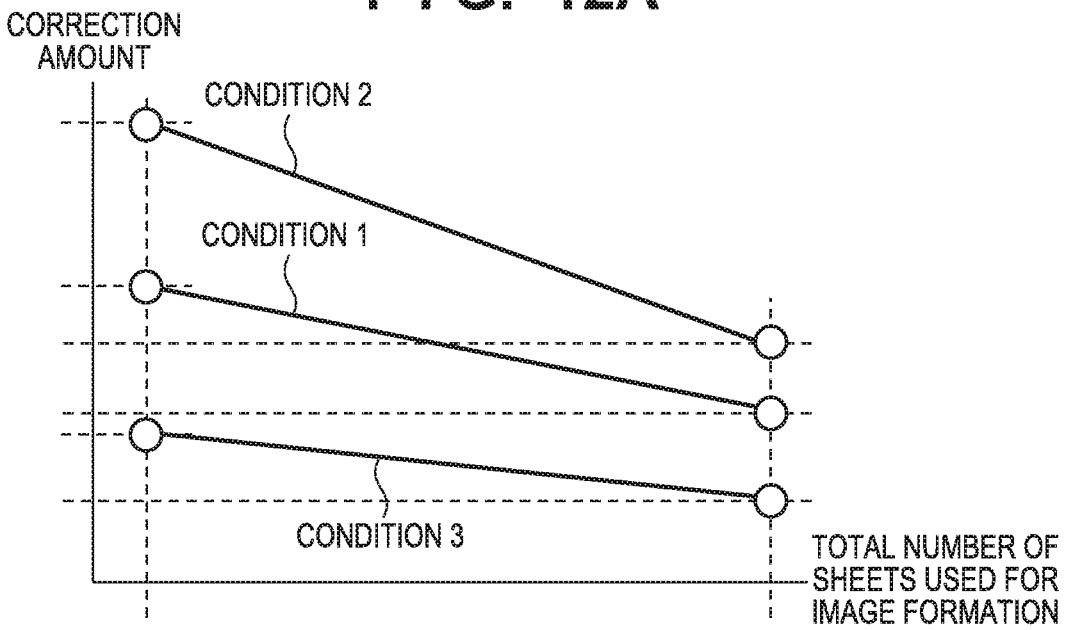
FIGS. 12A and 12B illustrate correction data according to one embodiment.
Figure 12B:
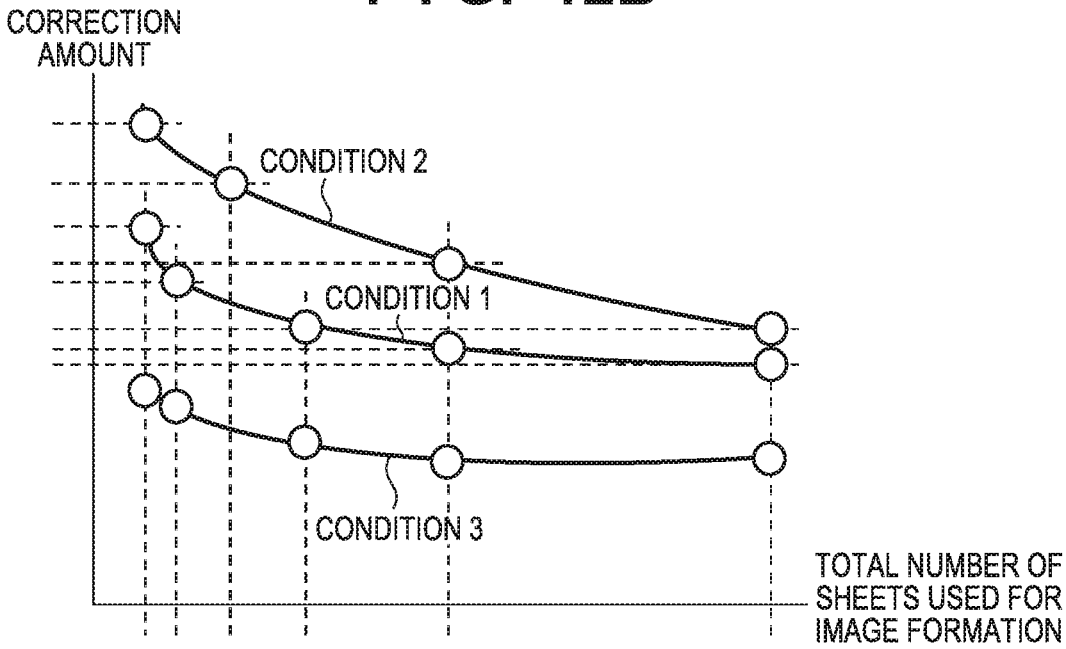

The following describes a second embodiment, and mainly the differences from the first embodiment. FIGS. 12A and 12B illustrate environmental variation around the image forming apparatus 100 (including the cartridge 108) and the correction amount due to aging. Here, it is assumed in the present embodiment that correction target pixels are fixed to the five pixels from the edge, and the correction amount is the same for each of the five correction target pixels.

FIG. 12A illustrates a case of a linear variation of the correction amount relative to the total number of sheets of the recording material 107 on which an image is formed (total number of sheets used for image formation) after starting the use of the cartridge 108. Here, conditions 1 to 3 are, respectively, conditions depending on the environment surrounding the image forming apparatus. For example, condition 1 is applied to a normal temperature and humidity environment, condition 2 is applied to an environment with a high temperature and humidity, and condition 3 is applied to an environment with a low temperature and humidity. FIG. 12B illustrates a case of a non-linear variation of the correction amount relative to the total number of sheets used for image formation. Here, conditions 1 to 3 are the same as those in FIG. 12A.

The white circles in FIGS. 12A and 12B, respectively, illustrate the total number of sheets used for image formation and the correction amounts to be stored in the storage medium 209 as the correction data 305. In FIG. 12A, the relation between the total number of sheets used for image formation and the correction amounts is linear, and therefore inclusion of the correction amounts for two total numbers of sheets used for image formation in the correction data 305 allows for calculating the correction amount for other total numbers of sheets used for image formation by linear interpolation. Here, in terms of the relation between the total number of sheets used for image formation and the correction amount, when the slope of the correction amount changes with respect to the variation of the total number of sheets used for image formation, it is also intended to include, in the correction data 305, the correction amount for the total number of sheets used for image formation that turns out to be the changing point. For example, when the slope of the correction amount for a total number of 1000 or fewer sheets used for image formation is different from the slope for a total number of 1000 or more sheets, it is intended to include, in the correction data 305, the correction amounts for a total number of zero, 1000, and 2000 sheets used for image formation. The parameter calculation unit 1202 calculates the correction amount for the total number of 1000 or fewer sheets used for image formation, based on the correction amounts for the total number of zero and 1000 sheets used for image formation, and calculates the correction amount for the total number of 1000 or more sheets used for image formation, based on the correction amounts for the total number of 1000 and 2000 sheets used for image formation.

Additionally, in FIG. 12B, the relation between the total numbers of sheets used for image formation and the correction amounts is non-linear, and therefore a plurality of representative points characteristic of the variation amount are intended to be included in the correction data 305. Here, it is conceivable to include, in the correction data 305, the relation between a correction amount for a certain condition and a correction amount for another condition. For example, conditions 2 and 3 of FIG. 12A may be information based on which the correction amounts for conditions 2 and 3 can be calculated from the correction amount for condition 1, instead of including the correction amounts for two numbers of sheets used for image formation in the correction data. For example, there may be a configuration that stores the difference between slopes, or the difference between sections, for condition 1 in the correction data 305. In this case, the parameter calculation unit 1202 obtains the correction amounts for conditions 2 and 3 from the correction amount for condition 1 via a predetermined calculation.

As has been described above, instead of including the correction amounts for all the total numbers of sheets used for image formation in the correction data 305, only the correction amounts for a part of the total numbers of sheets used for image formation are preliminarily stored. The parameter calculation unit 1202 then calculates the correction amount data 307 based on the correction data 305. According to the aforementioned configuration, it is possible to reduce the amount of the correction data 305, and suppress the phenomenon of excessive toner adhesion in each image formation.

Note that, in the present embodiment, it is intended to include, in the correction data 305, range information indicating that correction target pixels are five or fewer pixels from the edge. Note that, in a case where correction target pixels are fixed to five pixels from the edge regardless of the cartridge 108, there may also be a configuration providing the controller 703 with a setting that correction target pixels are fixed to five pixels, without including the range information in the correction data 305.

Third Embodiment

Subsequently, a third embodiment will be described, focusing on the difference from the first and the second embodiments. In the first and the second embodiments, it has been intended to store data of representative points in the correction data 305, and calculate the correction amount based on the data of representative points. In the present embodiment, it is intended to include, in the correction data 305, coefficients of an approximation function for calculating the correction amount, instead of the data of representative points.

For example, in the case of the first mode illustrated in FIG. 8, the relation between the distance X and the correction amount Y is expressed by the following formula.

$$Y=10X+20 \ (X=1 \text{ to } 3)$$

$$Y=-10X+80 \ (X=3 \text{ to } 5)$$

In the case of the second mode illustrated in FIG. 8, the relation between the distance X and the correction amount Y is expressed by the following formula.

$$Y=12X+12 \ (X=1 \text{ to } 3)$$

$$Y=-12X+84 \ (X=3 \text{ to } 5)$$

Here, although an error may occur at X=3, it is possible to reduce the amount of data by storing the data as described in the present embodiment, provided that the effect due to the error is small.

In the case of the third mode illustrated in FIG. 8, the relation between the distance X from the edge and the correction amount Y is expressed by the following formula.

$$Y=-(10/3)X^2+(80/3)X+20/3$$

In the present embodiment, coefficients of respective terms of the function are intended to be the correction data 305. Here, in the first and the second modes, different functions are to be applied in accordance with the distance, and therefore it is also intended to include, in the correction data 305, information about the extent of distance to which the coefficients of respective terms are to be applied. Here, for example, the order of the function can be determined by the number of coefficients.

As has been described above, inclusion of information, for example, coefficients for obtaining the function for calculating the correction amount in the correction data 305, allows for reducing the amount of the correction data 305, and suppressing the phenomenon of excessive toner adhesion.

As has been described above, the correction data 305 is preliminarily stored in the storage medium 209 of the cartridge 108. The correction data 305 is used by the image forming apparatus in order to determine, from the exposure amount indicated by the image data, the correction amount for correcting the exposure amount of a correction target pixel among a plurality of pixels indicated by the image data. However, in order to reduce the amount of the correction data 305 to be stored in the storage medium 209, the correction data 305 is intended to be data indicating only a correction amount corresponding to a representative parameter value of some of a plurality of parameter values of the first parameter for varying the correction amount. For example, in the first embodiment, the first parameter value is the distance from an edge of a pixel. Additionally, in the second embodiment, the first parameter value is the total number of sheets used for image formation. Note that the first parameter may be any parameter for varying the correction amount, without being limited to the distance from an edge of an image or the total number of sheets used for image formation. For example, the first parameter may be at least one of temperature and humidity of the image forming apparatus. In addition, the first parameter may be a combination of a plurality of parameters, such as, for example, a combination of the distance from an edge of an image and the total number of sheets used for image formation.

Furthermore, when there exists a second parameter which is different from the first parameter for varying the correction amount, the correction data 305 may indicate the representative parameter value and the correction amount for the first parameter when the second parameter is the reference value. In this case, the controller 703 identifies, based on the correction data 305, the first correction amount for the correction target pixel when the second parameter is the reference value. On the other hand, the controller 703 performs a predetermined calculation on the first correction amount to identify the second correction amount for the correction target pixel when the second parameter is a value which is different from the reference value. For example, the second parameter in the first embodiment corresponds to an operation mode with respect to speed, and the reference value is a value indicating the first mode. In addition, the second parameter in the second embodiment represents temperature and humidity conditions, and the reference value represents temperature and humidity corresponding to the first condition. Here, the second parameter in the second embodiment may represent temperature or humidity.

For example, the representative parameter value of the first parameter may be intended to include the minimum value and the maximum value of a plurality of parameter values of the first parameter. For example, when the first parameter is the distance from an edge of a pixel as described in the first embodiment, the image forming apparatus may identify a correction target pixel based on the maximum value or both the minimum value and the maximum value. Here, the range information is intended to be included in the correction data 305 when the first parameter is not the distance from an edge of a pixel, or when the correction amount for the maximum value is not to be included in the correction data 305 although the first parameter is the distance from an edge of a pixel. In this case, the image forming apparatus identifies the correction target pixel based on the range information. Here, when the distance from the edge of the correction target pixel is constant and is known by the image forming apparatus, the range information need not be included in the correction data 305.

In addition, the representative parameter value of the first parameter may be intended to include a parameter value indicating that the variation amount of the correction amount with respect to variation of the parameter value of the first parameter is larger than a predetermined value, or a parameter value indicating reversal of increase or decrease of the correction amount with respect to variation of the parameter value. The aforementioned configuration enables the image forming apparatus to identify the correction amount for the parameter value which is different from the representative parameter value by linear interpolation of the correction amount for the representative parameter value. In addition, there may also be a configuration including, in the correction data 305 as a representative parameter value and a correction amount thereof, a parameter value and a correction amount thereof required for the image forming apparatus to identify a function indicating the relation between the parameter value of the first parameter and the correction amount. In this case, the image forming apparatus determines the function indicating the relation between the parameter value and the correction amount based on the correction data 305, and identifies a correction amount for a parameter value which is different from the representative parameter value. Furthermore, as has been described for the third embodiment, the correction data 305 may also be intended to indicate coefficients of the relation between the parameter for varying the correction amount and the correction amount.

Here, the ease of occurrence of sweeping and the edge effect depends on the configuration of the developing unit 104, and therefore the image forming apparatus can determine whether to suppress sweeping or suppress edge effect depending on the type of the developing unit 104 of the cartridge 108 attached to the image forming apparatus. Here, it may also be intended to include, in the correction data 305, information indicating which of the sweeping or edge effect is to be suppressed, for example.

Additionally, it is intended in the embodiment described above that the cartridge 108, which is a replaceable unit, includes the photoconductor 101, the charging roller 102, the developing unit 104, and the storage medium 209. However, components other than the storage medium 209 of the cartridge 108 are not limited the foregoing. For example, the cartridge 108 may be intended to include a photoconductor 101, the charging roller 102, and the storage medium 209. Alternatively, the cartridge may be intended to include the developing unit 104 and the storage medium 209. For example, although there is intended to be a single cartridge 108 in the present embodiment, it may be divided into a first cartridge including the photoconductor 101, the charging roller 102 and the storage medium 209, and a second cartridge including the developing unit 104 and the storage medium 209. Here, the degree of sweeping and the edge effect differs depending on the properties of the photoconductor 101, for example, the sensitivity to light and the properties of the toner of the developing unit 104, for example, the toner color, number of executable prints by the cartridges, or the like. Accordingly, in the present embodiment, the correction data 305 conforming to the properties of the cartridge 108 is stored in the storage medium 209 of the cartridge 108. Accordingly, it becomes possible to perform correction conforming to the properties of the cartridge 108.

Note that, according to the present invention, there is provided the aforementioned cartridge intended to be mounted for use on an image forming apparatus. In addition, according to the present invention, there is also provided an image forming system including the aforementioned cartridge and a main body of an image forming apparatus. Furthermore, according to the present invention, there is provided the storage medium 209 readable by an image forming apparatus. The storage medium 209 of the cartridge stores a correction amount corresponding to a representative parameter value of at least some of a plurality of parameter values of a parameter for varying the correction amount.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-100727, filed on May 29, 2019, which is hereby incorporated by reference herein in its entirety.

What is claimed is:

1. A non-transitory storage medium readable by an image forming apparatus, comprising:

a storage unit configured to store correction data for the image forming apparatus to identify a correction amount for correcting an exposure amount of a correction target pixel, among a plurality of pixels indicated by image data, from an exposure amount indicated by the image data, wherein the correction data includes only a correction amount corresponding to each of representative parameter values of a plurality of parameter values of a predetermined parameter for varying the correction amount.

2. An image forming apparatus comprising:

a storage unit configured to store correction data;

an identifying unit configured to identify a correction amount for a correction target pixel based on the correction data stored in the storage unit;

a correction unit configured to correct an exposure amount of the correction target pixel, among a plurality of pixels indicated by image data, from an exposure amount indicated by the image data, based on the correction amount for the correction target pixel; and an image forming unit configured to form an image based on an exposure amount after correction by the correction unit, wherein the correction data includes only a correction amount corresponding to each of representative parameter values of a plurality of parameter values of a first predetermined parameter for varying the correction amount.

3. The image forming apparatus according to claim 2, wherein the representative parameter values include a minimum value and a maximum value of the plurality of parameter values of the predetermined parameter.

4. The image forming apparatus according to claim 2, wherein the representative parameter values include a parameter value indicating that a variation amount of the correction amount with respect to variation of the parameter value of the predetermined parameter is greater than a predetermined value.

5. The image forming apparatus according to claim 2, wherein the representative parameter values include a parameter value indicating reversal of increase or decrease of the correction amount with respect to variation of the parameter value of the predetermined parameter.

6. The image forming apparatus according to claim 2, wherein the identifying unit is further configured to identify the correction amount for a parameter value which is different from the representative parameter values of the correction data by linear interpolation of the correction amount for the representative parameter values.

7. The image forming apparatus according to claim 2, wherein the identifying unit is further configured to determine, based on the representative parameter values of the correction data, a function indicating a relation between a parameter value and the correction amount, and to identify, based on the function, the correction amount for a parameter value which is different from the representative parameter values of the correction data.

8. The image forming apparatus according to claim 2, wherein the correction amount varies according to a second predetermined parameter, the correction data indicates the correction amount when the second predetermined parameter is a reference value for the representative parameter values of the predetermined parameter, and the identifying unit is further configured to identify, based on the correction data, a first correction amount for the correction target pixel when the second predetermined parameter is the reference value, and to identify a second correction amount for the correction target pixel when the second predetermined parameter is a value which is different from the reference value by performing a predetermined operation on the first correction amount.

9. The image forming apparatus according to claim 8, wherein the second predetermined parameter includes at least one of an operation mode with respect to speed in the image forming apparatus temperature of the image forming apparatus, and humidity of the image forming apparatus.

10. The image forming apparatus according to claim 2, wherein the predetermined parameter includes a distance from an edge of an image formed from the image data.

11. The image forming apparatus according to claim 10, further comprising a determination unit configured to determine the correction target pixel from the plurality of pixels indicated by the image data based on a maximum value of the distance from the edge included in the representative parameter values.

12. The image forming apparatus according to claim 2, wherein the predetermined parameter includes at least one of a number of sheets used for image formation performed by the image forming apparatus, temperature of the image forming apparatus and humidity of the image forming apparatus.

13. The image forming apparatus according to claim 2, wherein the storage unit is provided on a cartridge which is attachable to and detachable from the image forming apparatus, and the cartridge includes at least one of a photoconductor and a developing unit configured to develop an electrostatic latent image formed by exposing the photoconductor that is electrically charged to light.

14. An image forming apparatus comprising:

a storage unit configured to store correction data;

an identifying unit configured to identify a correction amount for a correction target pixel based on the correction data stored in the storage unit;

a correction unit configured to correct an exposure amount of the correction target among a plurality of pixels indicated by image data, from an exposure amount indicated by the image data, based on the correction amount for the correction target pixel; and an image forming unit configured to form an image based on an exposure amount after correction by the correction unit, wherein the correction data indicates coefficients of a relation between a parameter for varying the correction amount and the correction amount.

15. A cartridge mounted for use on an image forming apparatus, the cartridge comprising:

at least one of a photoconductor and a developing unit configured to develop an electrostatic latent image formed by exposing the photoconductor that is electrically charged to light; and a storage unit configured to store correction data for the image forming apparatus to identify a correction amount for correcting an exposure amount of a correction target pixel, among a plurality of pixels indicated by image data, from an exposure amount indicated by the image data, wherein the correction data includes a correction amount corresponding to each of representative parameter values of a plurality of parameter values of a predetermined parameter for varying the correction amount.

16. The cartridge according to claim 15, wherein the correction data includes only a correction amount corresponding to each of the representative parameter values.

17. The cartridge according to claim 15, wherein the representative parameter values include a minimum value and a maximum value of the plurality of parameter values of the predetermined parameter.

18. The cartridge according to claim 15, wherein the representative parameter values include a parameter value indicating that a variation amount of the correction amount with respect to variation of the parameter value of the predetermined parameter is greater than a predetermined value.

19. The cartridge according to claim 15, wherein the representative parameter values include a parameter value indicating reversal of increase or decrease of the correction amount with respect to variation of the parameter value of the predetermined parameter.

20. The cartridge according to claim 15, wherein the correction amount varies according to a second predetermined parameter, and the correction data indicates the correction amount when the second predetermined parameter is a reference value for the representative parameter values of the predetermined parameter.

21. The cartridge according to claim 20, wherein the second predetermined parameter includes at least one of an operation mode with respect to speed in the image forming apparatus, temperature of the image forming apparatus and humidity of the image forming apparatus.

22. The cartridge according to claim 15, wherein the predetermined parameter includes a distance from an edge of an image formed from the image data.

23. The cartridge according to claim 15, wherein the predetermined parameter includes at least one of a number of sheets used for image formation performed by the image forming apparatus, and temperature of the image forming apparatus and humidity of the image forming apparatus.

24. The cartridge according to claim 15, wherein the storage unit has the correction data stored based on a property of the cartridge.

25. A cartridge mounted for use on an image forming apparatus, the cartridge comprising:

at least one of a photoconductor and a developing unit configured to develop an electrostatic latent image formed by exposing the photoconductor that is electrically charged to light; and a storage unit configured to store correction data for the image forming apparatus to identify a correction amount for correcting an exposure amount of a correction target pixel, among a plurality of pixels indicated by image data, from an exposure amount indicated by the image data, wherein the correction data indicates coefficients of a relation between a parameter for varying the correction amount and the correction amount.

26. An image forming system comprising:

an image forming apparatus; and a cartridge mounted for use on the image forming apparatus, wherein the cartridge includes:

at least one of a photoconductor and a developing unit configured to develop an electrostatic latent image formed by exposing the photoconductor that is electrically charged to light; and a storage unit configured to store correction data for the image forming apparatus to identify a correction amount for correcting an exposure amount of a correction target pixel, among a plurality of pixels indicated by image data, from an exposure amount indicated by the image data, and the image forming apparatus includes:

a correction unit configured to correct an exposure amount of the correction target pixel, from an exposure amount indicated by the image data, based on the correction amount identified from the correction data; and an image forming unit configured to form an image on a sheet based on an exposure amount after correction by the correction unit, the correction data including only a correction amount corresponding to each of representative parameter values of a plurality of parameter values of a predetermined parameter for varying the correction amount.

27. An image forming system comprising:

an image forming apparatus; and a cartridge mounted for use on the image forming apparatus, wherein the cartridge includes:

at least one of a photoconductor and a developing unit configured to develop an electrostatic latent image formed by exposing the photoconductor that is electrically charged to light; and a storage unit configured to store correction data for the image forming apparatus to identify a correction amount for correcting an exposure amount of a correction target pixel, among a plurality of pixels indicated by image data, from an exposure amount indicated by the image data, and the image forming apparatus includes:

a correction unit configured to correct an exposure amount of the correction target pixel, from an exposure amount indicated by the image data, based on the correction amount identified from the correction data; and an image forming unit configured to form an image on a sheet based on an exposure amount after correction by the correction unit, the correction data indicating coefficients of a relation between a parameter for varying the correction amount and the correction amount.

28. A non-transitory storage medium readable by an image forming apparatus, comprising:

a storage unit configured to store correction data for the image forming apparatus to identify a correction amount for correcting an exposure amount of a correction target pixel, among a plurality of pixels indicated by image data, from an exposure amount indicated by the image data, wherein the correction data indicates coefficients of a relation between a parameter for varying the correction amount and the correction amount.

* * * * *